United States Patent [19]

Bladholm et al.

[11] 3,935,689

[45] Feb. 3, 1976

[54] TRANSMISSION LINE STRUCTURE

[75] Inventors: Thomas A. Bladholm, Mound; William T. McCalla, Brooklyn Park, both of Minn.

[73] Assignee: Contran Corporation, Osseo, Minn.

[22] Filed: Apr. 1, 1974

[21] Appl. No.: 456,982

[52] U.S. Cl. ..... 52/722; 174/45 R

[51] Int. Cl.[2] ..... E04C 3/30

[58] Field of Search ..... 52/40, 697, 721, 722, 726, 52/28, 227; 174/43, 45; 240/81, 84 R, 84 A

[56] References Cited

UNITED STATES PATENTS

| | | | |
|---|---|---|---|
| 923,557 | 6/1909 | Milliken | 52/40 |
| 1,567,301 | 12/1925 | Ross | 52/40 |
| 2,212,990 | 8/1940 | Maler | 52/403 |
| 2,627,176 | 2/1953 | Levy | 52/396 |
| 2,920,476 | 1/1960 | Finfrock | 52/40 |

FOREIGN PATENTS OR APPLICATIONS

| | | | |
|---|---|---|---|
| 1,540,295 | 1/1970 | Germany | 174/45 |
| 577,049 | 10/1956 | Italy | 52/722 |
| 53,470 | 1/1946 | France | 52/40 |

*Primary Examiner*—John E. Murtagh

*Attorney, Agent, or Firm*—Merchant, Gould, Smith & Edell

[57] ABSTRACT

A new transmission line support structure including a pair of poles and a superstructure supported from below on the tops of the poles and comprising one or several crossarm units each of which includes a crossarm and may include a plurality of upwardly extending pole extensions. Each crossarm unit is secured to the tops of a pair of poles or pole extensions by means which act in directions parallel to the axes of the poles and prevent transverse motion therebetween, and which may include elastomeric pad means.

3 Claims, 5 Drawing Figures

TRANSMISSION LINE STRUCTURE

BACKGROUND OF THE INVENTION

This invention relates to the field of transmission line structures, and particularly to such structures for very high voltage uses, requiring very tall poles and very long crossarms. The general field of transmission lines is very thoroughly worked, and travelers observe many lines of various forms extending across the country including highly complicated structural steel towers at one extreme and single wooden poles at the other.

An important consideration in the design of a transmission line structure is that of expense. A quite economical structure has been found to consist of a pair of vertical wooden poles spaced laterally of the right of way: shield wires extending from pair to pair of these poles are secured to their tops, and the conductors of the line itself are suspended on insulators from a crossarm secured to the poles below the shield wires. Where the poles are of any considerable height it has been found indispensable to provide diagonal bracing extending transversely between them. Such a structure is shown in Cofer et al. U.S. Pat. No. 2,606,952.

Some concept of the dimensions of interest here is necessary to a fuller understanding of the problems to be solved. For a 400 kilovolt direct current transmission line, with the shield wires to be 101 feet above the ground, the total length of a pole is about 114 feet, of which over 13 feet are underground. The crossarm length is more than 50 feet, the top of a crossarm is about 79 feet above the ground, and the poles are laterally spaced by nearly 20 feet.

The necessity of diagonal cross bracing in so sizable a wooden structure is quite obvious. Moreover, as is pointed out in the Cofer et al. patent, it is highly undesirable to bore any holes or cut any gains in the poles, for structural reasons and to prevent stray currents and lightning discharges from being conducted to the interior of the poles by metal fasteners in the holes. Clamping arrangements have therefore been devised to secure crossarms, braces, and so forth to the poles. The resulting structure initially may have the desired rigidity, but it requires a great deal of hardware, much initial assembly expense in the field, and continued periodic maintenance after installation. It must not be forgotten also that the poles and crossarms must be transported, often for long distances and frequently by road: this involves the expense, nuisance, and delay of obtaining permits, where the load is of excessive length or weight, and the provision of leading and following flag cars in addition to the actual transport vehicle upon occasion, all of which adds very substantially to the expense of a structure by the time it is installed.

Finally, even if properly designed and braced, the support described above is a statically indeterminate structure, the forces in the poles which result from a wind force at the top, for example, being distributed in a fashion which is modified to a major extent, even to serious damage to the poles, by such apparently minor dimensional changes as often occur due to differential pole settling after installation. Omission of the diagonal braces would cure this problem, but cannot be resorted to because of the structural inadequacy of the unbraced poles.

SUMMARY OF THE INVENTION

It is a principal object of this invention to provide a new and improved transmission line structure which requires no cross bracing, is relatively easy to transport and erect, and when erected results in a strong, stable structure which is easier to design for particular conditions because it is at all times statically determinate. This is accomplished by making the crossarm as a unit which rests on top of poles of shorter length, with which pole extensions for shield wires may be integral or to which they may be readily attached. This design makes it possible to use prestressed reinforced concrete for the poles and the crossarm units, giving a strength and load path which eliminate the need of diagonal bracing.

Various other objects, advantages, and features of novelty which characterize our invention are pointed out with particularity in the claims annexed hereto and forming a part hereof. However, for a better understanding of the invention, its advantages, and objects attained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings.

FIG. 5 shows a modification of the structure of FIG. 1.

DESCRIPTION OF THE PREFERRED EMBODIMENT

Figure 1:
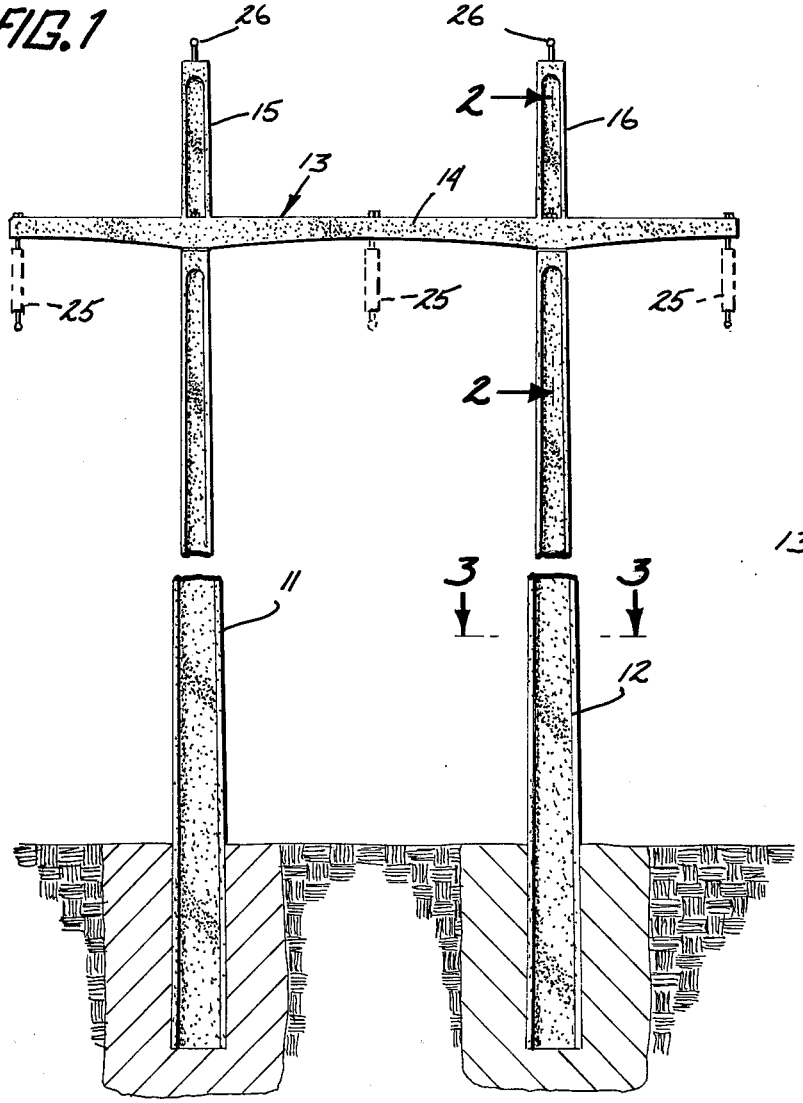
FIG. 1 shows a transmission line structure according to our invention, seen in the direction of the right of way.
Figure 2:
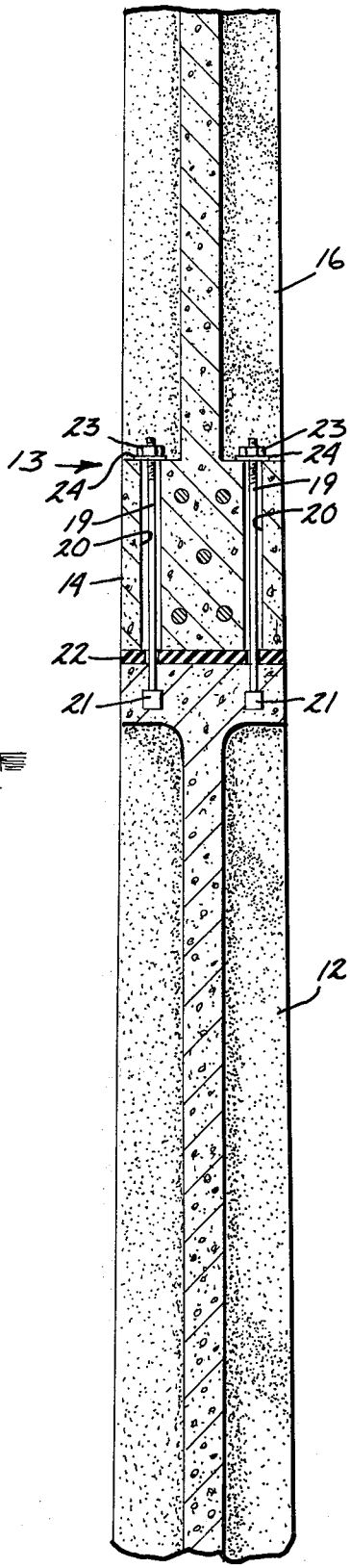
FIG. 2 is a fragmentary showing along the line 2—2 of FIG. 1.
Figure 3:
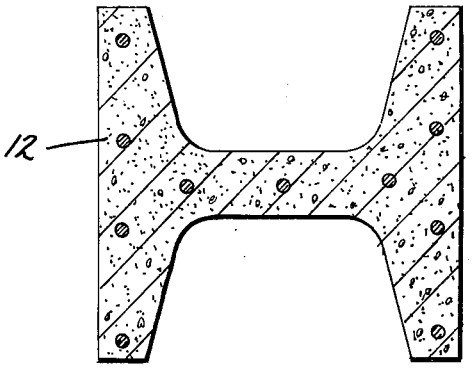
FIG. 3 is a section of a pole taken along the line 3—3 of FIG. 1.

Turning now to the drawings, a transmission line structure according to our invention is shown in FIGS. 1–3 to comprise a pair of poles 11 and 12 and a superstructure comprising a crossarm unit 13 made up of a crossarm 14 and a pair of pole extensions 15 and 16 integral therewith. The poles and the crossarm are both made of prestressed concrete: the poles and pole extensions may have a section such as that shown in FIG. 3, and the crossarm may have a rectangular cross section as shown in FIG. 2. The pattern of reinforcing steel shown in FIG. 2 and 3 is illustrative only and is not intended to be limiting.

The crossarm unit is supported on top of the poles, to which it is secured by means acting compressively in directions parallel to the axes of the poles. This may be accomplished, as shown in FIG. 2, by a pair of studs 19 passing through holes 20 in unit 13 and threadedly received in sleeves 21 cast into the top of pole 12. An elastomeric pad 22 is provided at the top of each pole for cushioning the contact between the pole and the upper unit, which is secured by nuts 23 acting against washers 24.

The usual insulators 25 are suspended from crossarm 14 for supporting the high tension wires, and appropriate hardware 26 is supplied at the tops of the stub poles to secure the usual shield wires.

Observation of FIG. 1 makes it clear that the total length of the pole is reduced in this arrangement by the height of the superstructure, a matter of some 22 feet in the case referred to previously, from 101 feet to 79 feet, and of course the weight of the pole is reduced accordingly. The advantage accruing from this reduction in mass when the pole is being erected is obvious, but there is also a great advantage as far as transport is concerned, in the reduction in length.

When it is desired to erect my transmission line structure, suitable holes are prepared in the earth, and the poles are set to the required depth, being carefully plumbed and spaced, as well as being positioned so that the line joining the tops of the poles is level. This may conveniently be done, after the studs are inserted in sleeves 21, by placing the first pole and partially back-filling. The second pole is then erected, the pads are positioned, and then the crossarm is lowered over the studs of both poles, and secured in place, after which the final back-filling is done at the base of the poles. Other methods of erection may also be used at the choice of the installer, depending on the terrain of the location.

It will be realized that any lateral forces on the pole extensions, due to wind on the shield wires, for example, have only an effective moment arm of 79 feet rather than one of 101 feet on the main poles, because force is transmitted by the crossarm to the pole tops only in shear. The superior characteristics of prestressed concrete as a material for poles, combined with the effect of the crossarm installed as described, make it unnecessary to provide diagonal cross braces, with their disturbing effect on forces in the poles, and also greatly simplify erection of the structure.

Figure 4:
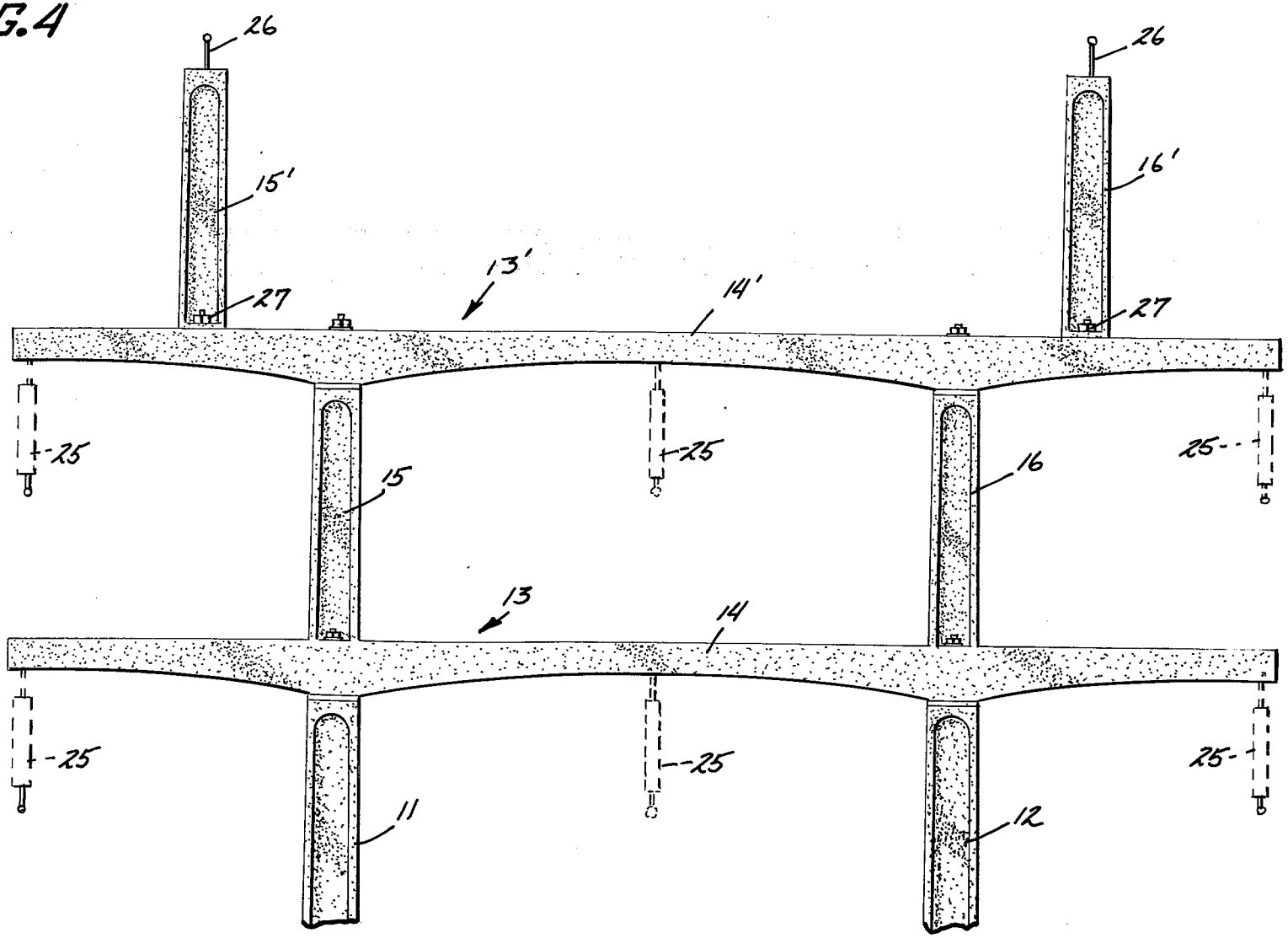
FIG. 4 shows our invention applied where a plural of crossarms are needed.

Occasion sometimes arises to provide more than one crossarm on a pair of poles. FIG. 4 shows a structure in which a second crossarm unit 13′ is installed on the pole extensions 15 and 16 of a first crossarm unit 13, the shield wires being in turn carried on the pole extensions 15′ and 16′ of the second unit.

FIG. 4 also shows a modification of the invention in which the pole extensions are not coaxial with the main poles, but are displaced outwardly from that position and are secured to the crossarms by suitable means 27 rather than integral with them. This illustrates a design freedom made available by our concept, in that the lateral locations and even the number of pole extensions are independent of the main support poles.

Numerous objects and advantages of our invention have been set forth in the foregoing description, together with details of the structure and function of the invention, and the novel features thereof are pointed out in the appended claims. The disclosure, however, is illustrative only, and changes may be made in detail especially in matters of shape, size, and arrangement of parts, within the principle of the invention, to the full extent indicated by the broad general meaning of the terms in which the appended claims are expressed.

What is claimed is:

1. A transmission line structure comprising, in combination:

a plurality of poles of prestressed concrete, each having a bottom end for securement to the ground and a flat top end;

a superstructure including at least one cross arm unit of prestressed concrete having a pair of spaced flat under surfaces supported from below on the flat top ends of said poles, and comprising a cross arm and at least one conductor-supporting pole extension unitary therewith and projecting upwardly therefrom;

and axially extending means rigidly securing said superstructure to the tops of said poles, including studs embedded in and extending axially from said poles, apertures in said superstructure, at the locations of said flat under surfaces, spaced for traversal by said studs, and nuts mating with the portions of said studs which extend upward through said superstructure, and engaging said superstructure.

2. The structure of claim 1 together with means for supporting electrical conductors from said cross arms and said pole extension, and elastomeric pad means between said flat under surfaces and said tops of said poles.

3. Apparatus according to claim 1 in which said superstructure includes a plurality of said crossarm units, and the last-named means includes means for securing one of said units upon the tops of a spaced pair of said poles and means for securing another of said units on the tops of the pole extensions of the first unit.

* * * * *